United States Patent [19]
Inoue et al.
[11] 4,396,085
[45] Aug. 2, 1983

[54] TURBOSUPERCHARGER AND ITS ASSOCIATED MEANS

[75] Inventors: Kazuo Inoue, Tokyo; Minoru Matsuda, Chofu; Kentaro Kato, Niiza, all of Japan

[73] Assignee: Hondak Giken Kogyo Kabushiki Kaisha, Tokyo, Japan

[21] Appl. No.: 295,292

[22] Filed: Aug. 24, 1981

[30] Foreign Application Priority Data

Sep. 17, 1980 [JP] Japan ..... 55/127896

[51] Int. Cl.[3] ..... F02D 23/00; B62D 63/04
[52] U.S. Cl. ..... 180/219; 60/605
[58] Field of Search ..... 180/219, 54 A; 60/600, 60/601, 602, 603, 605

[56] References Cited

U.S. PATENT DOCUMENTS 3,611,711 10/1971 Müeller ..... 60/600
3,926,274 12/1975 Morioka et al. ..... 180/219

OTHER PUBLICATIONS

"More Turbos from Japan", Automotive Engineering, vol. 89, No. 4, Apr. 1981, pp. 65–68.

"Turbo Cycle", Popular Science, Nov. 1981, pp. 60 & 65.

*Primary Examiner*—Joseph F. Peters, Jr.
*Assistant Examiner*—Donn McGiehan
*Attorney, Agent, or Firm*—Sughrue, Mion, Zinn, Macpeak and Seas

[57] ABSTRACT

A turbosupercharger includes an exhaust turbine and a compressure, each connected together by an intermediate shift. The exhaust turbine is disposed in an exhaust passage positioned at downstream side of an exhaust manifold positioned in front of an engine and connected to an exhaust port of the engine. The compressor is disposed in an intake passage connected to an intake port of the engine. The exhaust port and intake port are positioned at front and rear sides of the engine, respectively. The exhaust turbine and the compressor are disposed sidy by side and transversely provided with respect to a frame of motorcycle and in front of said engine. The rotational axis of the turbosupercharger is rotated downwardly at the side near the engine, and the compressor is provided with a scroll opening oriented upwardly. Further, the exhaust manifold is covered with a cover member spacedly positioned in front of the manifold.

6 Claims, 11 Drawing Figures

TURBOSUPERCHARGER AND ITS ASSOCIATED MEANS

BACKGROUND OF THE INVENTION

The present invention relates to a turbosupercharger and its associated means for primary use in a motorcycle.

A motorcycle generally mounts a V-type engine or other types of multicylinder engine at the longitudinal center of a frame which provides front and rear wheels. A turbosupercharger and its associated means has been proposed wherein the turbosupercharger includes an exhaust turbine and a compressor. The exhaust turbine is positioned at one side of the frame of the motorcycle and is accomodated in an exhaust passage positioned at downstream side of an exhaust manifold positioned in front of an exhaust port of the engine. On the other hand, the compressor is positioned at the other side of the frame and is accomodated in an intake passage connected to an intake port of the engine. With this structure, the intake passage bridging between the engine and a scroll opening of the compressor is obliged to have a complicated bent shape, so that it would be rather difficult to produce and assemble such intake passage. Further, the intake passage is obliged to be positioned at a space encircled by the engine, the exhaust manifold and the turbosupercharger. Therefore, the intake passage is heated, to thereby degrade the combustion efficiency. Moreover, such intake passage provides large conduit resistance against fluid flow passed therethrough due to the complicated bent configuration.

Furthermore, the exhaust manifold is positioned in front of the engine, so that exhaust gas to be introduced into the exhaust turbine is subject to cooling due to running of the motorcycle through air. As a result, thermal efficiency of the exhaust turbine is lowered.

SUMMARY OF THE INVENTION

It is therefore, an object of the present invention to overcome the above-mentioned drawbacks and to provide an improved turbosupercharger and its associated means.

Another object of the present invention is to provide such turbosupercharger and its associated means capable of providing an intake passage having simple configuration, which simultaneously minimizes conduit resistance against fluid flow passing therethrough and can be positioned outside the space defined by the engine, exhaust manifold and the turbosupercharger.

Still another object of the present invention is to provide such means which prevents the exhaust manifold from being cooled by air during running of the motorcycle.

These and other objects of the present invention will be attained by providing a turbosupercharger including an exhaust turbine and a compressor each positioned at an exhaust port side and an intake port side, respectively. The exhaust turbine is positioned in an exhaust passage positioned at downstream side of an exhaust manifold connected to the exhaust port of a V-type engine or other multicylinder engine, while the compressor provides a scroll opening and is positioned in an intake passage connected to the intake port of the engine. The turbosupercharger has a front side confronting a front wheel and a rear side confronting the engine. The rotation of the turbosupercharger is determined to rotate downwardly at the rear side thereof, and the scroll opening of the compressor is oriented upwardly. Further, the exhaust manifold is positioned in front of the engine, and a protective cover is spacedly provided in front of the exhaust manifold to provide a gap therebetween.

These and other object of this invention will become apparent from the description of the drawings and the preferred embodiments which follow:

DETAILED DESCRIPTION OF THE PREFERRED EMBODIMENTS

Figure 1:
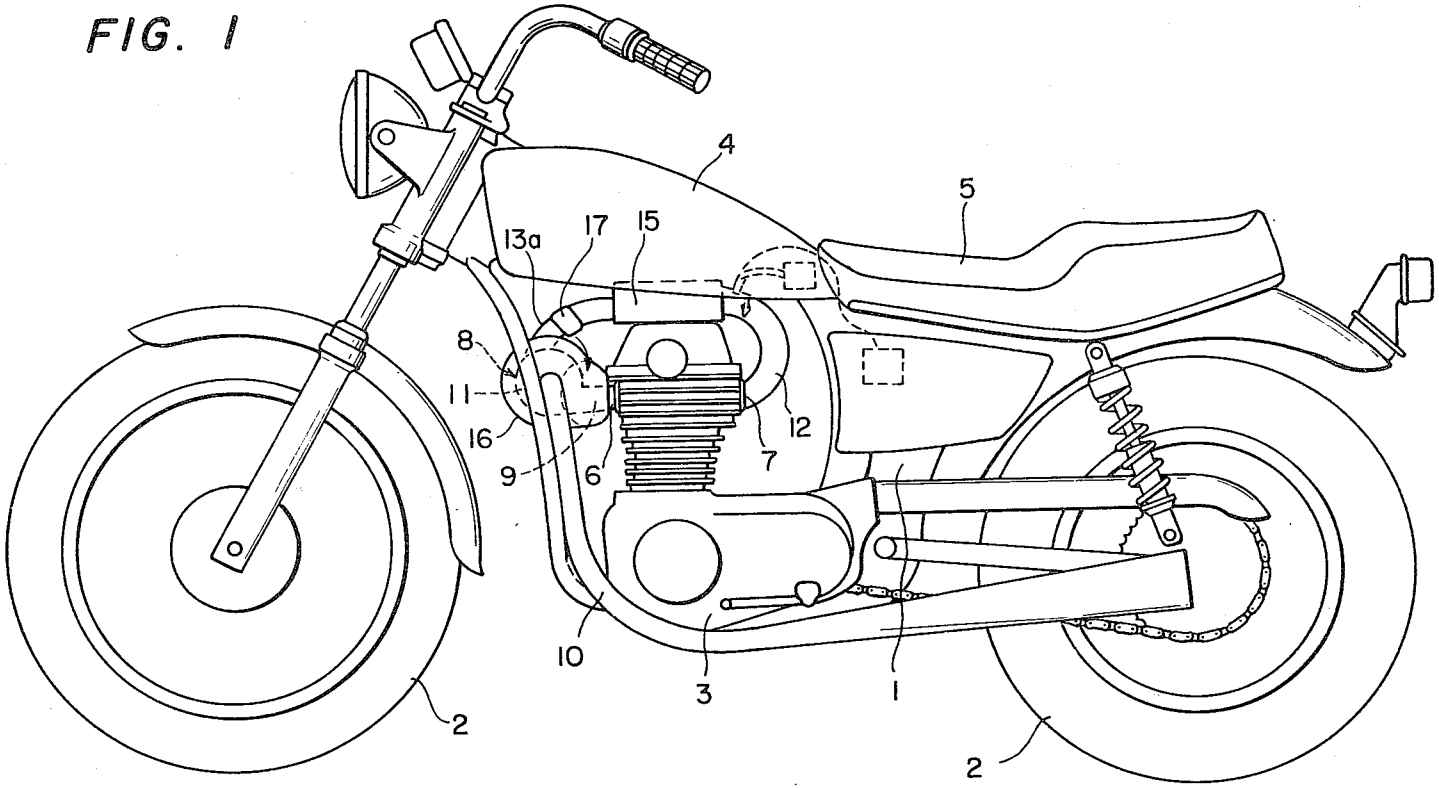
FIG. 1 is a side view of a motorcycle including a turbosupercharger and its associated means according to the present invention.
Figure 2:
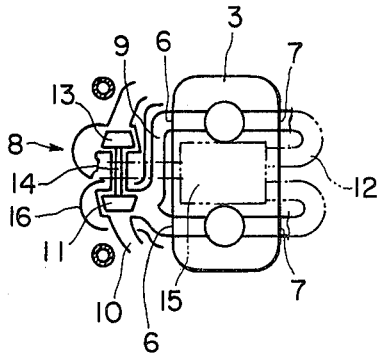
FIG. 2 is a cross-sectional plan view showing an essential portion of the present invention.

A first embodiment of the present invention is shown in FIGS. 1 and 2, wherein a frame 1 of a motorcycle is provided with a front and rear wheels 2 and a multicylinder engine 3 at the longitudinally center portion thereof. A fuel tank 4 is disposed above the engine 3 and a passenger seat 5 is disposed at the rear side of the fuel tank 4.

The engine has a front side formed with an exhaust port 6 and a rear side formed with an intake port 7. At the front side of the engine, i.e., at the exhaust port side, a turbosupercharger 8 is provided. As shown in FIG. 2, the turbosupercharger 8 includes an exhaust turbine 11 and a compressor 13 each laterally disposed side by side with respect to the frame 1 and connected together by an intermediate shaft 14. The exhaust turbine 11 is positioned within an exhaust passage 10 positioned at downstream side of an exhaust manifold 9 connected to the exhaust port 6. The compressor 13 is positioned within an intake passage 12 connected to the intake port 7. Further, a prechamber 15 is provided in the path of the intake passage 12.

According to the present invention, the turbosupercharger 8 is rotated downwardly at the side near the engine 8, and a scroll opening 13*a* of the compressor 13 is oriented upwardly. More specifically, the turbosupercharger 8 is positioned in front of the engine 3, so that the rear side of the charger 8 confronts the engine. As shown by an arrow in FIG. 1, the turbosupercharger 8 is rotated in clockwise direction so as to rotate downwardly at the rear side thereof. Further, the scroll opening 13*a* is oriented upwardly as shown in FIG. 1. With this arrangement, the intake passage 12 can be bridged between the scroll opening 13*a* of the compressor and the intake port 7 arcuately, eliminating complicated bent configuration, and can be positioned above the engine. That is, the front end of the intake passage 12 can be connected to the upwardly directed scroll opening 13*a* through a rubber joint 17, and the passage 12 can extend above the engine 3 via the prechamber 15 positioned above the engine, and the rear end of the intake passage 12 can be connected to the intake port 7 positioned at the rear side of the engine 3. Therefore, the intake passage 12 is of simple arcuate shape, avoiding complicated bent configuration. Further, the intake passage 12 can be positioned outside the space defined by the engine 3, the exhaust manifold 9 and the turbosupercharger 8. As a result, the intake passage 12 is not subject to heating by the engine, to thereby maintain combustion efficiency. Further, since the passage 12 is of simple configuration, a fluid passing therethrough is not subject to large conduit resistance, to thereby obtain smooth flow.

An adiabatic cover 16 is provided in front of the engine 3 so as to spacedly cover the exhaust system. The cover 16 is described later in detail. The shape of the adiabatic cover 16 can be simplified, since the intake passage 12 is positioned spaced apart from the exhaust system.

Figure 4:
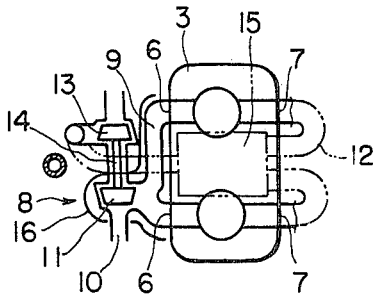
FIG. 4 is a cross-sectional plan view showing an essential portion of the second embodiment of the present invention.
Figure 3:
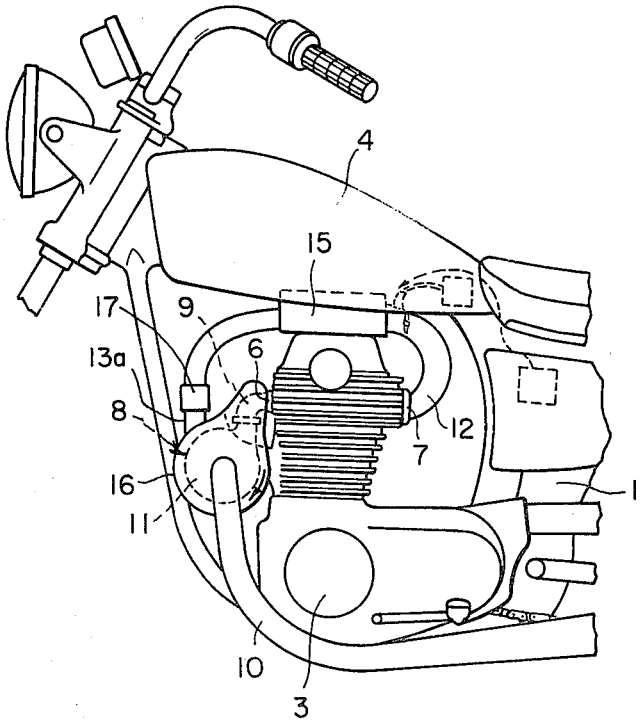
FIG. 3 is a partial side view of a motorcycle including a turbosupercharger and its associated means according to a second embodiment of the present invention.
Figure 5:
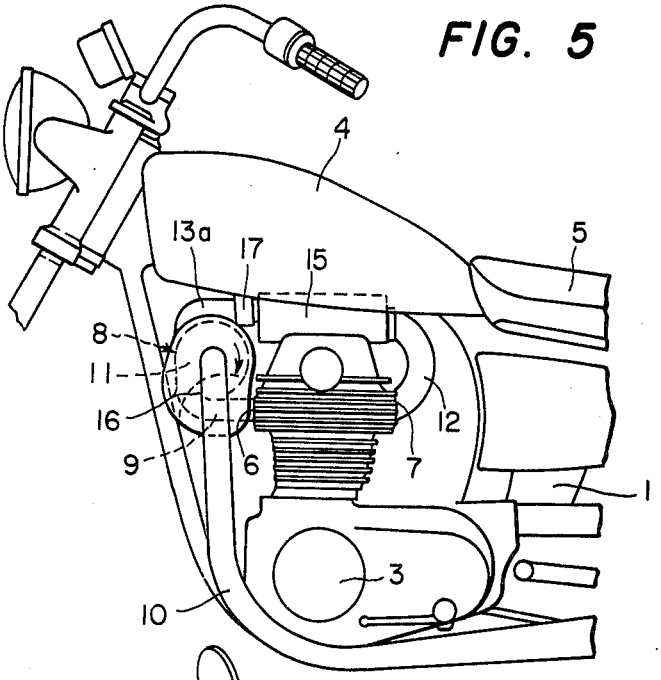
FIG. 5 is a partial side view of a motorcycle including a turbosupercharger and its associated means according to a third embodiment of the present invention.

A second and third embodiments of the present invention are shown in FIGS. 3 and 4 and FIG. 5, respectively, wherein like parts and components are designated by the same reference numerals and character as those shown in the first embodiment. In the second embodiment, the turbosupercharger 8 is positioned slightly lower than the position shown in the first embodiment, whereas in the third embodiment, the turbosupercharger 8 is positioned slightly higher than the position shown in the first embodiment.

Figure 6:
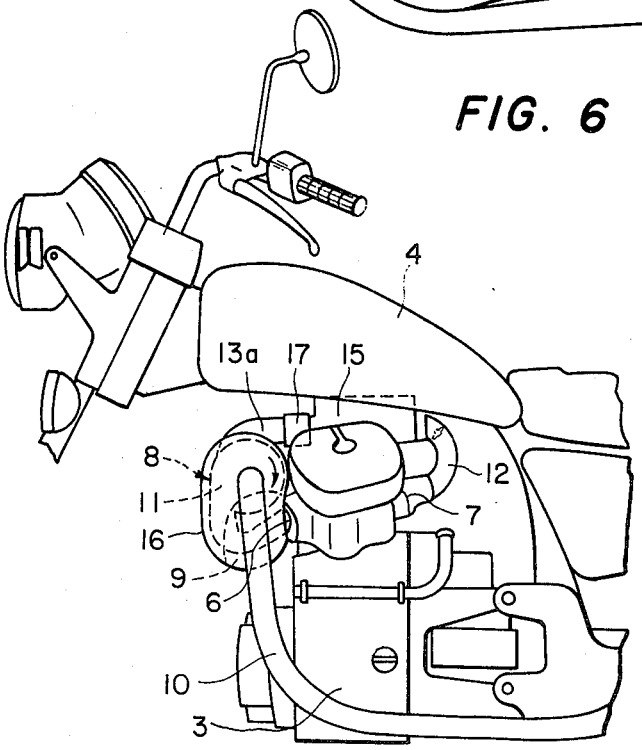
FIG. 6 is a partial side view of a motorcycle including a turbosupercharger and its associated means according to a fourth embodiment of the present invention.
Figure 7:
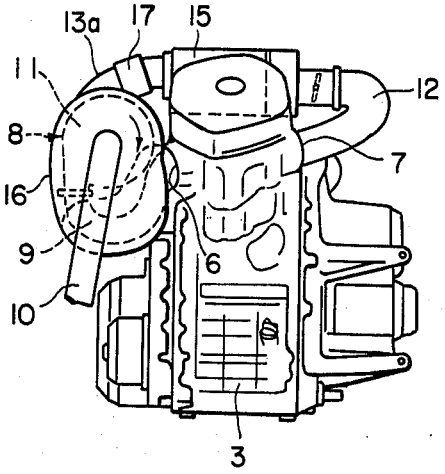
FIG. 7 is a side view showing an essential portion of a turbosupercharger and its associated means according to the fourth embodiment of the present invention.
Figure 8:
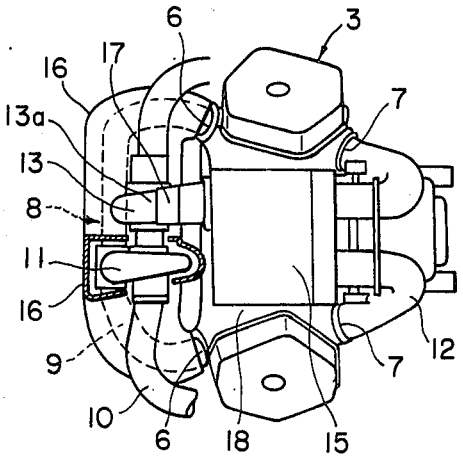
FIG. 8 is a plan view showing an essential portion of a turbosupercharger and its associated means according to the fourth embodiment of the present invention.

A fourth embodiment of this invention is shown in FIGS. 6 thru 8, wherein the engine 3 is of a V-type engine having a V-shaped bank 18 at the upper surface thereof. With this structure, the prechamber 15 can be positioned within the V-shaped bank 18, so that the vertical length of the intake passage 12 can be reduced.

Figure 11:
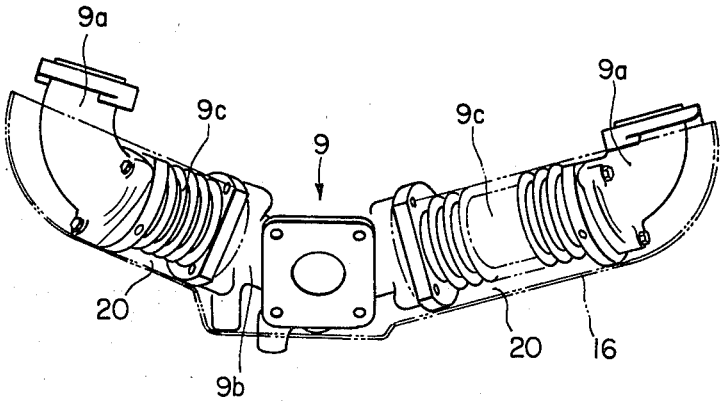
Figure 9:
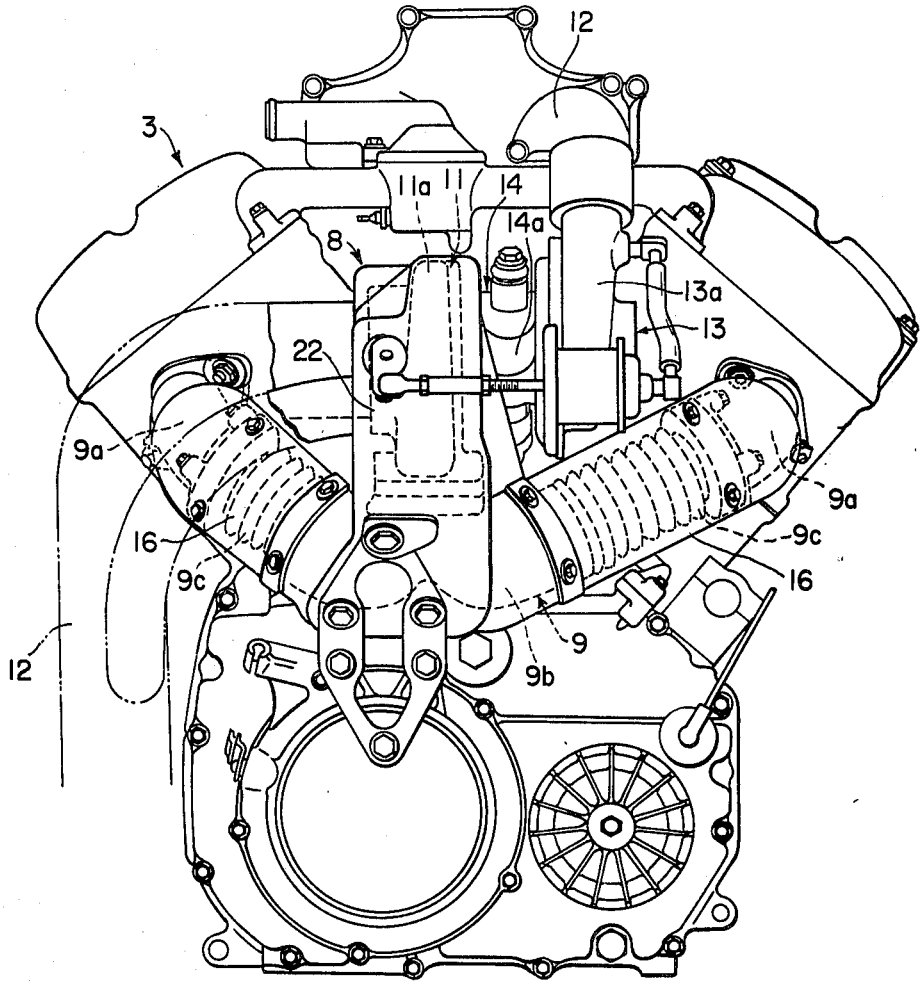
FIG. 9 is a front view showing a detail of an exhaust manifold according to the present invention.
Figure 10:
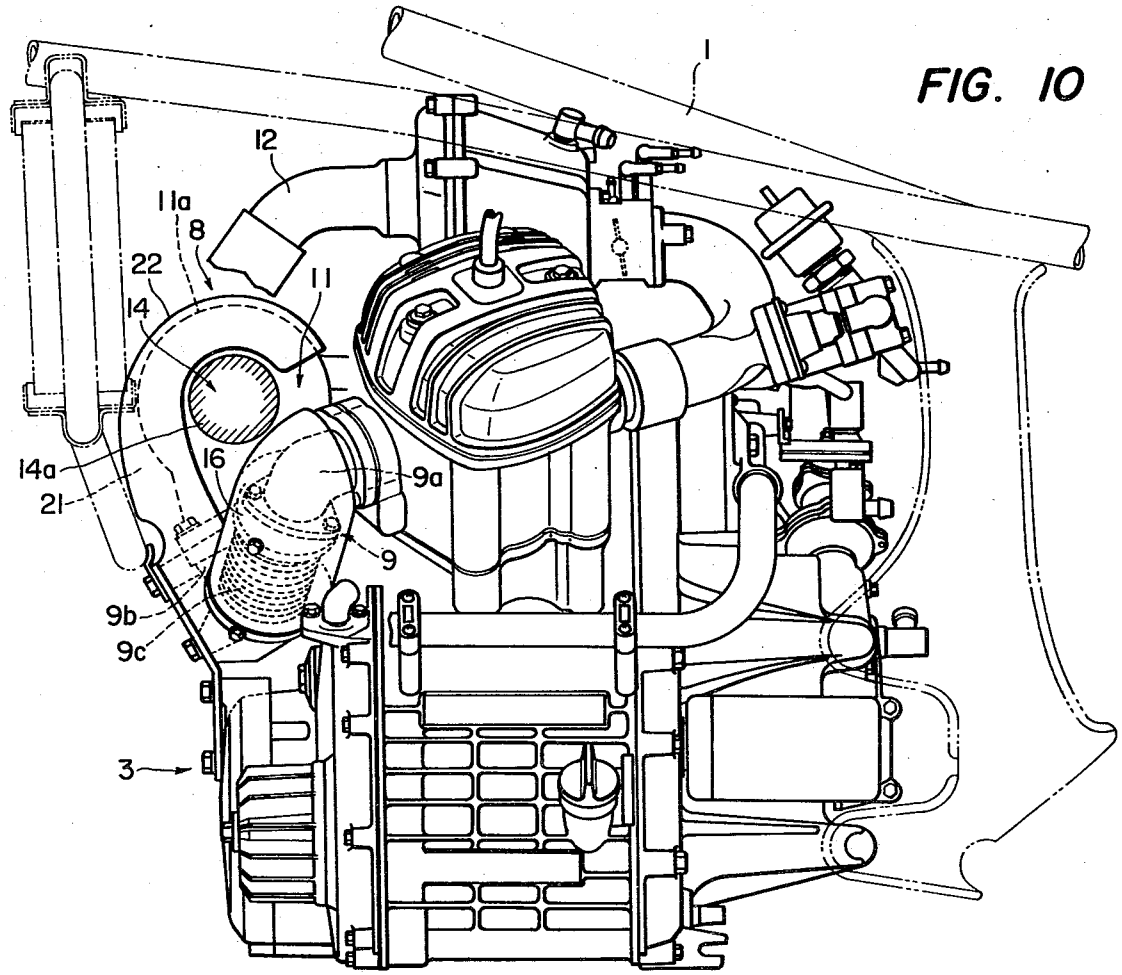
FIG. 10 is a side view showing a detail of an exhaust manifold shown in FIG. 9; and, FIG. 11 is a plan view showing an essential portion of an exhaust manifold according to the present invention.

FIGS. 9 thru 11 show a details of the exhaust manifold and its attendant members with the employment of the V-type engine. The exhaust manifold 9 frontwardly extends from the engine 3, and consists of opening portions 9*a* connected to the exhaust ports of respective cylinders of the engine 3, a congregated discharge portion 9*b* disposed in front of the opening portions 9*a* and centrally positioned relative to the openings 9*a*, and intermediate connecting portions 9*c* each interposed between the opening portion 9*a* and the discharge portion 9*b*. The connecting portions 9*c* are formed of flexible members such as bellows. The turbosupercharger 8 mentioned above is disposed above the discharge portion 9*b*.

The exhaust manifold 9 is positioned in front of the engine 3, and therefore, it is subject to cooling due to the air stream of the motorcycle. As a result, the exhaust gas within the exhaust manifold 9 is cooled, to thus lower thermal efficiency of the exhaust turbine 11. According to the present invention, the adiabatic cover 16 is spacedly disposed in front of the exhaust manifold 9 defining a gap 20 (FIG. 11) therebetween in order to prevent the manifold 9 from being cooled. As shown in FIGS. 9 thru 11, if desired, the cover 16 has a configuration to cover upper and lower portions of the exhaust manifold 9 as well as the front portion thereof.

Further, according to the embodiment shown in FIGS. 9 to 11, an additional cover 22 is spacedly provided in front of the turbosupercharger 8, specifically in front of the exhaust turbine 11 so as to define a gap 21 (FIG. 10) therebetween. The turbosupercharger 8 also includes an outer casing 11*a* for the exhaust turbine 11, an outer casing 13*a* for the compressor 13 and an outer casing 14*a* for the intermediate shaft 14. The additional cover 22 is positioned in front of the outer casing 11*a* of the exhaust turbine 11 so as to cover the casing 11*a* only. Thus, the temperature decrease of the exhaust gas in the exhaust turbine 11 can be prevented, while the compressor 13 and the intermediate shaft 14 are subject to cooling with air during travel of the motorcycle.

In view of the above, according to the present invention, the turbosupercharger is rotated downwardly at the engine side, and the scroll opening of the compressor is oriented upwardly, so that the intake passage can provide simple configuration eliminating complicated surpentine shape, and the intake passage can be positioned outside of the space encircled by the engine, exhaust manifold and the turbosupercharger, whereby conduit resistance is minimized and the heat application to the intake passage can be prevented.

Further, according to the present invention, the exhaust manifold positioned in front of the engine is spacedly covered with the adiabatic cover member positioned in front of the exhaust manifold, so that the cooling of the exhaust manifold is prevented, to thus enhance thermal efficiency of the exhaust turbine.

While the invention has been described in detail and with reference to specific embodiments thereof, it will be apparent to one skilled in the art that various changes and modifications can be made therein without departing from the spirit and scope of the invention.

What is claimed is:

1. In a turbosupercharger for use in a motorcycle, including an exhaust turbine and a compressor, said exhaust turbine being disposed in an exhaust passage positioned at downstream side of an exhaust manifold positioned in front of an engine and connected to an exhaust port of said engine, and said compressor being disposed in an intake passage connected to an intake port of said engine, a rotational axis of said turbosupercharger extending transversely relative to a frame of said motorcycle and in front of said engine, the improvement comprising; said turbosupercharger being rotated downwardly at the side near said engine, and said compressor having a scroll opening oriented upwardly.

2. The improvement of claim 1, wherein said intake passage bridges between said scroll opening of said compressor and said intake port of said engine, and is positioned above said engine.

3. The improvement of claim 1, further comprising a prechamber positioned above said engine and in the path of said intake passage.

4. The improvement of claim 1 or 3, wherein said engine is a V-type engine and said prechamber is positioned in a V-bank defined by an upper surface of said V-type engine.

5. The improvement of claim 1, further comprising a first cover member spacedly positioned around and in front of said exhaust manifold.

6. The improvement of claim 1, wherein said exhaust turbine is provided with an outer casing, and further comprising a second cover member spacedly positioned around end in front of said outer casing.

* * * * *